US008731432B1

(12) United States Patent
Goldie

(10) Patent No.: US 8,731,432 B1
(45) Date of Patent: May 20, 2014

(54) TONER TANK SEAL

(75) Inventor: Glenn C. Goldie, Granby, CT (US)

(73) Assignee: Turbon America, Inc., Pennsauken, NJ (US)

( * ) Notice: Subject to any disclaimer, the term of this patent is extended or adjusted under 35 U.S.C. 154(b) by 155 days.

(21) Appl. No.: 13/467,407

(22) Filed: May 9, 2012

Related U.S. Application Data

(60) Provisional application No. 61/494,566, filed on Jun. 8, 2011.

(51) Int. Cl.
*G03G 15/08* (2006.01)

(52) U.S. Cl.
USPC ..... 399/103; 399/106

(58) Field of Classification Search
CPC ..... G03G 15/0898; G03G 15/0881; G03G 15/0882; G03G 2215/0687; G03G 2215/0877; G03G 2215/088
USPC ..... 399/103, 106, 119, 120, 262
See application file for complete search history.

(56) References Cited

U.S. PATENT DOCUMENTS 7,155,137 B2 * 12/2006 Yasui et al. ..... 399/103
2012/0063805 A1 * 3/2012 Jun et al. ..... 399/103

* cited by examiner

*Primary Examiner* — Sophia S Chen
(74) *Attorney, Agent, or Firm* — James R. Klaiber; Pryor Cashman LLP

(57) ABSTRACT

This invention provides a seal for the tank/developer section of a two-piece toner cartridge that is applied externally to the section at the opening of the developer roller, where it is intended to confront the drum in the fully assembled cartridge. The seal assembly includes a resilient seal member, illustratively constructed from a stiffening bar that caps a resilient/pliable foam or another elastomer. The foam impinges on the doctor blade where it meets the developer roller, to bias the doctor blade against the developer roller and seal this region against the exit of toner. The foam and stiffening bar have an elongated length that matches the developer opening so that this region is fully sealed along its length. The stiffener is flexibly attached to a sheet material. The sheet is secured to the cartridge surface at a respective edge on each side by releasable adhesive.

17 Claims, 7 Drawing Sheets

TONER TANK SEAL

RELATED APPLICATION

This application claims the benefit of U.S. Provisional Application Ser. No. 61/494,566, filed Jun. 8, 2011, entitled TONER TANK SEAL, the entire disclosure of which is herein incorporated by referece.

FIELD OF THE INVENTION

This invention relates to laser printer toner cartridges, and more particularly to mechanisms for sealing cartridges during shipment.

BACKGROUND OF THE INVENTION

Laser printers are one of the most ubiquitous and useful equipment pieces in business and residential computing/document-handling environments. Their print engines employ a replaceable cartridge containing photoconductive drum that transfers black and white (or color) toner particles from a tank containing a reserve of such toner to a print medium, such as paper. The toner is electrostatically charged so that it is drawn from the tank onto a magnetized developer roller or other means that turns in conjunction with the photoconductive drum. The layer of toner deposited on the drum is then transferred to the charged regions of the drum. These charged regions conform to the image-to-be-printed, and are formed by a moving light beam (typically a solid-state laser) under the control of a print driver. The drum transfers the toner in the regions to the medium (e.g. paper) as moves against the rotating drum. After applying the toner to the medium, the drum passes through a wiper that removes any excess toner and a corona unit that de-charges the drum for re-exposure by the laser.

Many commercially available cartridges, such as the E360 series by Lexmark International, Inc. of Lexington, Ky., are provided as two-piece cartridge systems. That is, the tank and developer assembly is removably cradled within a photoconductive drum assembly. A gear train interconnects the drum to the tank assembly. In this manner, the less expensive tank components can be recycled when toner is exhausted, while the more-expensive and longer-lived drum assembly is retained. This increases the efficiency of the toner cartridge life-cycle by attending to the replacement of an exhausted toner supply, while avoiding the need to deal with the photoconductive drum until its service life is actually near an end.

Toner tanks are filled to a predetermined level by the original equipment manufacturer (OEM). In general, that level is less than the total volume of the tank. Many manufactures, such as Clarity Imaging Technologies, Inc. of Springfield, Mass., provide extended life versions of OEM cartridges that are more economical for users, and also more environmentally friendly, due to their longer life and less-frequent change-out schedule. A variety of proprietary techniques are employed to provide an extended life performance. One aspect of this technique is adding more toner to the tank than that provided by the OEM. For an extended-life cartridge to function properly with an increased toner level, modification of a variety of cartridge functions and parameters, such as the agitator timing, is typically required.

A particular consequence of an increased toner load in the cartridge tank is that the internal seals, which normally act to prevent loss of toner to the environment may be overwhelmed. One such seal is formed between the developer roller and its confronting doctor blade. By way of example, when performing a so-called "drop test" to verify the cartridge's commercial acceptability, the cartridge is released from a predetermined altitude onto a hard surface. A standard-life cartridge passes such a test because its internal components can resist the force of the toner load in the tank as it rapidly decelerates on impact. However, the increased mass and volume of the toner load in an extended life cartridge may cause some toner to be forced through the seal between the doctor blade and developer roller, and exit the cartridge. Other causes of toner loss can include (but are not limited to) vibration encountered during shipment and handling. In normal commerce, it is highly undesirable for a delivered cartridge to exhibit lost toner, as it leads to messy work areas and clothing, and generally reduces the user's confidence in the quality and value of the unit.

Therefore, it is desirable to provide a system for preventing the exit of toner from a tank/developer assembly of a two-piece toner cartridge in both standard-life and extended-live units. This system should be inexpensive and easy to implement on existing cartridge designs and should avoid the need to redesign any cartridge components. This system should also be straightforward to manipulate by a user and should ensure minimal or no loss of toner for both standard-life and extended-life toner cartridges of a variety of types and from a variety of manufacturers.

SUMMARY OF THE INVENTION

This invention overcomes disadvantages of the prior art by providing a seal for the tank/developer section of a two-piece toner cartridge (the other piece being the photoconductive image drum assembly) that is applied externally to the section at the opening of the developer roller, where it is intended to confront the drum in the fully assembled cartridge (i.e. both sections assembled together for use). The seal is removed before the two pieces are assembled. The seal includes a resilient, widened seal member, illustratively constructed from a resilient/pliable foam or an elastomer, and a stiffening bar. The foam impinges on the doctor blade where it meets the developer roller, so as to bias the doctor blade against the developer roller and effectively seal this region against the exit of toner when it confronts the region under pressure (e.g. when dropped). The foam and stiffening bar have an elongated length that matches the developer opening so that this region is fully sealed along its length. The stiffening bar is flexibly attached to a sheet material, such as durable paper or card stock. The sheet extends along each the surface of the tank section in each of opposing directions from the seal. It is illustratively secured to the cartridge surface at a respective edge on each side (i.e. either side of the seal/stiffening bar) by a removable adhesive strip or tape. It can also (or alternatively) use interlocking tabs or clips to adhere the seal sheet to an associated structure (original or modified) on the cartridge housing. The sheet provides holding pressure to the seal to maintain it in place and also effects a low-profile on the cartridge for ease of packaging. In operation, the user removes the sheet by unpeeling the adhesive strips and then lifts the seal from the tank/developer section before attaching it to the drum section.

In an alternate embodiment, the seal and stiffening bar can be a one-piece unit with a resilient edge and stiff body. The stiffening bar in any embodiment can be formed from a variety of materials, such as wood, metal (e.g. aluminum), polymer, hard rubber, cardboard, and the like. The sheet can be paper, polymer, metal foil or a combination. In a further embodiment, the sheet and the stiffening bar can be formed as a unitary member with a resilient material (e.g. foam) adhered to the top of the stiffening bar on at least a portion of the top and one or two sides thereof. Illustratively, the sheet is molded or vacuum-formed from a polymer material that includes a raised stiffening bar residing remote from the four sides of the sheet. The adhesive can be a separate structure or can be applied directly to the edges of the sheet. Structures shaped as pull tabs can be applied to or formed on one or more edges of the sheet. In alternate embodiments, the seal can be held in place by a sheet that surrounds the cartridge section, such as a polymer shrink-wrap.

In an illustrative embodiment the sealing assembly for a section of a toner cartridge having a developer roller and doctor blade includes a flexible sheet constructed and arranged to extend over the developer roller and doctor blade between a first side and a second side of a housing surface of the section. A stiffening bar and pliable cap assembly is interconnected with the flexible sheet that engages a region defined by the doctor blade, developer roller and an adjacent portion of the section. This arrangement biases the doctor blade into a predetermined sealing orientation with respect to the developer roller and generally prevents it from deforming in a manner that allows toner to leak.

BRIEF DESCRIPTION OF THE DRAWINGS

The invention description below refers to the accompanying drawings, of which.

DETAILED DESCRIPTION

Figure 1:
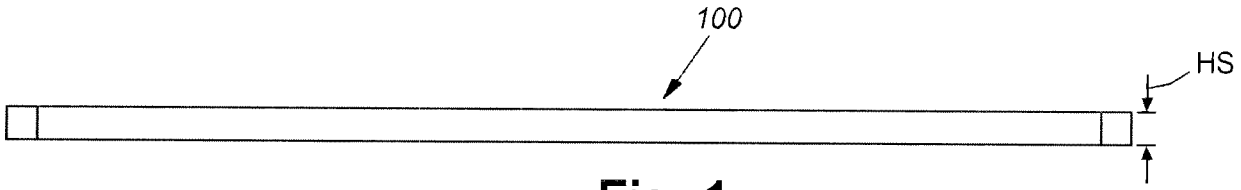
FIG. 1 is a side view of a stiffening bar for a toner cartridge tank section seal according to an illustrative embodiment.
Figure 2:
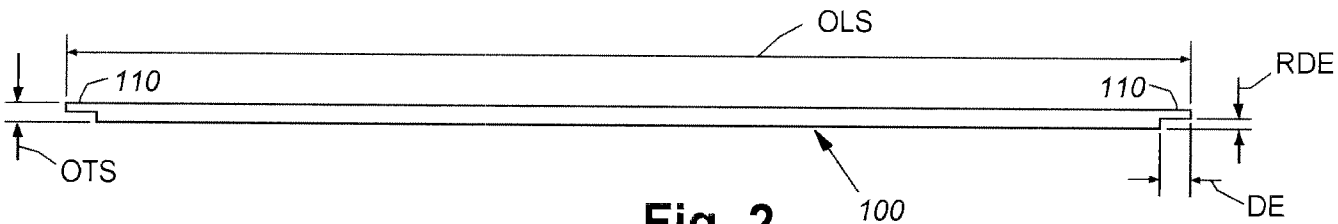
FIG. 2 is a top view of the stiffening bar of FIG. 1.

FIGS. 1 and 2 show a stiffening bar 100 (or simply termed a "stiffener") that forms the backbone of a toner cartridge tank section seal in accordance with an illustrative embodiment. The dimensions of the bar are highly variable. By way of non-limiting example, the seal described herein is constructed and arranged to sealingly engage the tank section on a two-piece, Lexmark E360 toner cartridge unit and its equivalents. However, it should be clear to those of skill that this seal assembly can be adapted to operate with any toner cartridge having a developer roller and doctor blade that interface with the outside environment. For example, the seal assembly described herein can be adapted to interface with cartridges sourced by such well-known companies as Canon of Japan, Hewlett Packard (HP) of Palo Alto, Calif., Brother International (USA) of Bridgewater, N.J., and the like.

The stiffening bar can be constructed from any acceptable material, including, but not limited to metal (e.g. aluminum), polymer (e.g. polyethylene, PET, polystyrene, etc.), composite, fiber (e.g. masonite) or wood. In this embodiment it has an overall length (taken in the widthwise direction of the cartridge) OLS of approximately 9.0-9.1 inches, a height HS of approximately 0.25 inch, and an overall thickness OTS of approximately 0.15 inch. The opposing ends 110 of the bar 100 define a reduced thickness RDE of approximately 0.08 inch for a distance DE of approximately 0.25 inch. As described further below, during installation on a cartridge tank section, this reduced thickness provides clearance for certain tank structures and allows the unit to be accurately seated on the cartridge. These end sections are optional, and can be omitted or provided with a differing geometry in alternate embodiments.

Figure 5:
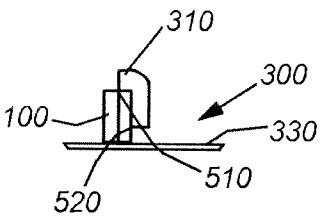
FIG. 5 is a fragmentary side cross section of the toner tank sealing assembly at the region of the stiffening bar, taken along line 5-5 of FIG. 3.
Figure 3:
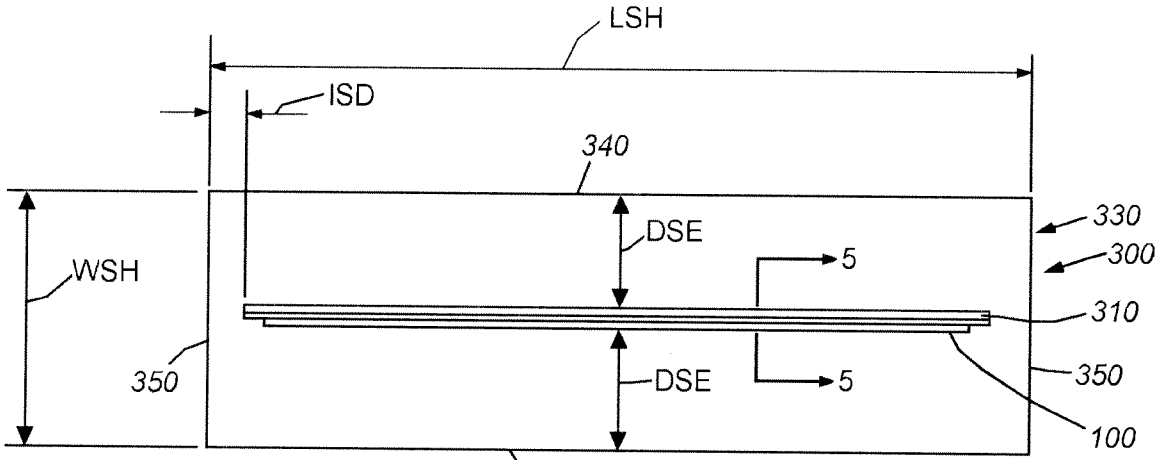
FIG. 3 is a top view of a toner tank section seal assembly including the stiffening bar of FIG. 1 according to an illustrative embodiment.
Figure 4:
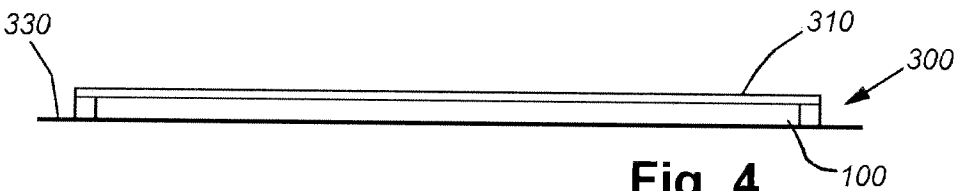
FIG. 4 is a side view of the toner tank section seal assembly of FIG. 3.

With further reference to FIGS. 3-5 the seal assembly 300 is shown in further detail with the stiffening bar 100 forming part of the overall seal assembly 300. The seal assembly 300 includes a foam cap 310 adhered to the top and side edge of the stiffening bar along the full length OLS of the bar. The foam cap 310 in this embodiment is illustratively constructed from urethane and is commercially available as 4318 urethane foam tape from 3M Corporation of St. Paul, Minn. It is expressly contemplated that an another type or make of pliable or elastomeric material can be employed in alternate embodiments. For example, a silicone rubber cap can be employed. In this embodiment, the foam is approximately 0.1-0.2 inch thick, and is adhered across at least a portion of the top edge 510 and at least an upper portion of the side edge 520 of the stiffening bar 100 as shown in FIG. 5, thereby defining an inverted L-shaped cap for the bar 100. As described below, the L-shape cap can be substituted with a U-shaped cap that covers the top of the stiffening bar and at least a portion of both sides of the stiffening bar.

The stiffening bar is attached by glue, tape, welding and/or fasteners (or another acceptable attachment technique) to a sheet 330 of paper, card stock fabric or polymer that is flexible, or semi-flexible. Illustrative, a paper sheet is used. The bar 100 and pliable cap 310 are adhered to the approximate center of the sheet. In this embodiment, the sheet has a width WSH of approximately 3 inches and a length LSH (taken in a widthwise direction of the cartridge) of approximately 10 inches. In this embodiment. Each side edge of the stiffening bar 100 is offset from the confronting sheet edge 340, 342 by a distance DSE of approximately 1.425 inches. Likewise, each opposing end of the stiffening bar 100 is inset from the confronting edge 350 of the sheet 330 by a distance ISD of approximately 0.4-0.5 inches. In this embodiment, the sheet is generally rectangular. It is expressly contemplated that all dimensions for the sheet 330 and the relative location of the stiffening bar thereon are highly variable, based on the geometry of the cartridge-to-be-sealed and/or on other (possibly arbitrary) design and sizing considerations. Thus the dimensions provided herein are by way of non-limiting example. In an alternate embodiment, the bar 100 can be mounted off-center with respect to the edges 340, 342 and/or 350. The thickness of the sheet is also highly variable and should be sufficient to provide needed retention force to the seal without breaking under a predetermined maximum level applied external force or shock (i.e. at least the force generated in a drop test).

In an embodiment, the sheet is colored approximately black in shade to blend any toner that may still manage to escape the joint or nip between the developer roller and the doctor blade. In alternate embodiments, the sheet can be another shade/color, such as white, transparent and/or specular.

Figure 6:
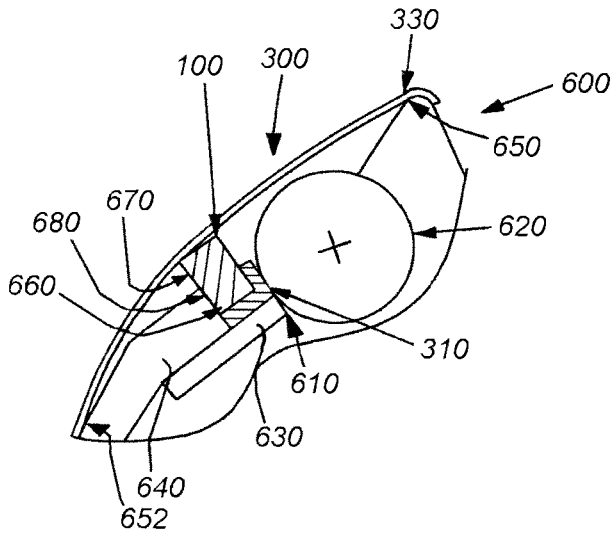
FIG. 6 is a fragmentary side cross section of an exemplary toner tank section having the seal assembly according to the embodiment of FIG. 3 mounted at the junction of the developer roller and doctor blade.

With reference to FIG. 6, the seal assembly 300 is shown installed in a toner tank section 600 of a two-piece toner cartridge. As described above, this seal assembly contemplated herein can be adapted to engage with any appropriate make or model of cartridge by sizing and arranging the assembly's various components/structures to conform to that cartridge's parameters. The sizing and arranging of the seal assembly to fit a given cartridge should be clear to those of skill in the art when reading this Description and taking into account the particular dimensions of the toner tank unit to which the seal is being fit. The illustration of FIG. 6 focuses upon the joint 610 between the developer roller 620 and the confronting doctor blade 630, which is supported by the shell 640 of the unit 600. As shown, the sheet 330 biases the stiffening bar 100 toward the doctor blade 630. The foam cap 310 compresses against the blade to protect it and the developer roller from scratching, and to ensure a compressive engagement between the seal assembly 300 and the tank section 600. The foam may deform slightly during compression, but its pliability absorbs any unevenness or excess pressure (within limits) applied between the blade and seal assembly. That is, in its attached position, the foam cap 310 is slightly compressed (loaded), and conforms to the shape of the blade without unduly deforming it. In the event of a force or shock applied to the blade by the toner contained therein, the seal assembly 300 reinforces the shape of the blade and prevents it from deforming outwardly—which would otherwise cause toner to exit. In stead, toner remains within the tank, where it belongs.

As described below, the sheet 330 is secured to opposing sides of the tank section's exterior surface 650, 652 by removable adhesive strips, tape or another acceptable attachment mechanism (for example, shrink wrap). This maintains the seal in place during shipment. The sheet 330 also serves to cover and protect the overall region of the developer roller and the doctor blade against tampering and/or contamination until the unit is ready to use. Notably, the size and shape of the seal assembly 300 provides a low, non-protruding profile that allows the cartridge to be packed (for example, in a plastic tube bag) in the same manner as a non-sealed cartridge. Thus no modifications to existing packing equipment are required. The geometry of the seal assembly also renders it easy to install by minimally skilled personnel. That is, the stiffening bar is centered in the region 660 of the doctor blade 630 and roller 620 as shown. The foam-free side 670 of the bar 310 abuts a wall 680 defined by the tank section housing. In this manner, the foam cap 310 fills the region 660, engaging the roller and the blade, so that there is minimal (if any) play once the bar 100 is seated and loaded with holding pressure. Then the opposing ends of the sheet (edges 340, 342 are removably secured/adhered along at least a portion of their length (the cartridge's widthwise direction) to the surface of the tank section 600 using a light tension force.

Figure 7:
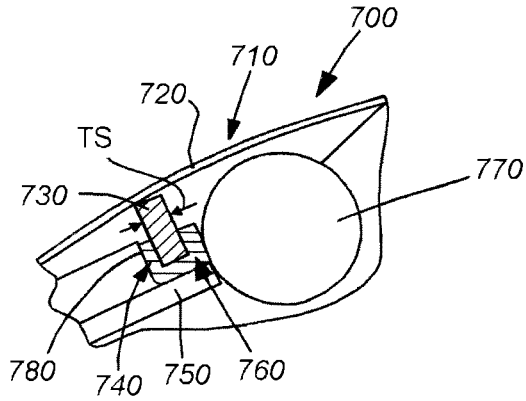
FIG. 7 is a fragmentary side cross section of an exemplary toner tank section having the seal assembly, according to an alternate embodiment, mounted at the junction of the developer roller and doctor blade.

With reference to FIG. 7, an exemplary toner tank section 700 of a toner cartridge unit is shown in partial side cross section. The seal assembly 710 in an alternate embodiment contains a sheet 720 that can be similar or identical in construction to the sheet 330 described above. The sheet 720 is removably secured/adhered to the surface of the tank section 700 using adhesive, tape or another mechanism as described above. The sheet biases a stiffening bar 730 that, in this embodiment, has a smaller thickness TS than the overall thickness OTS of the above-described stiffening bar 100. The thickness is sized and arranged to allow the foam cap 740 to surround the top and at least a portion of both sides of the bar 730. The foam can be of a thinner, thicker, or similar thickness to that of the foam cap 310 described above. Likewise a variety of differing pliable materials can be used in alternate embodiments. In this embodiment, the use of a foam cap formed in a U-shape, which covers the top and at least a portion of both edges of the stiffening bar, allows the seal to seat snugly and securely within the region 760 above the doctor blade 750 between the developer roller 770 and the opposing wall 780 of the tank section housing.

It should be clear that a stiffening bar and seal can be formed as a unitary structure from an elastomer that has both pliability and a degree of rigidity. More generally, a unitary sheet and stiffening bar structure can be formed so that the stiffening bar exhibits a spring action. Such an assembly, formed by vacuum-forming or molding techniques is described further below. In another embodiment, the stiffening bar itself can be co-extruded from at least two materials so the cap section is relatively pliable and compressible (forming a good seal and avoiding damage to components); while the stiffening bar section is a more rigid material. Likewise, while the base of the bar (attached to the sheet), opposite the cap is a straight edge, in alternate embodiments the cross-sectional shape of the bar base can define (for example) a widened flair, a T-shape or other increased surface area that facilitates a more-secure interconnection between the bar and the sheet.

Figure 8:
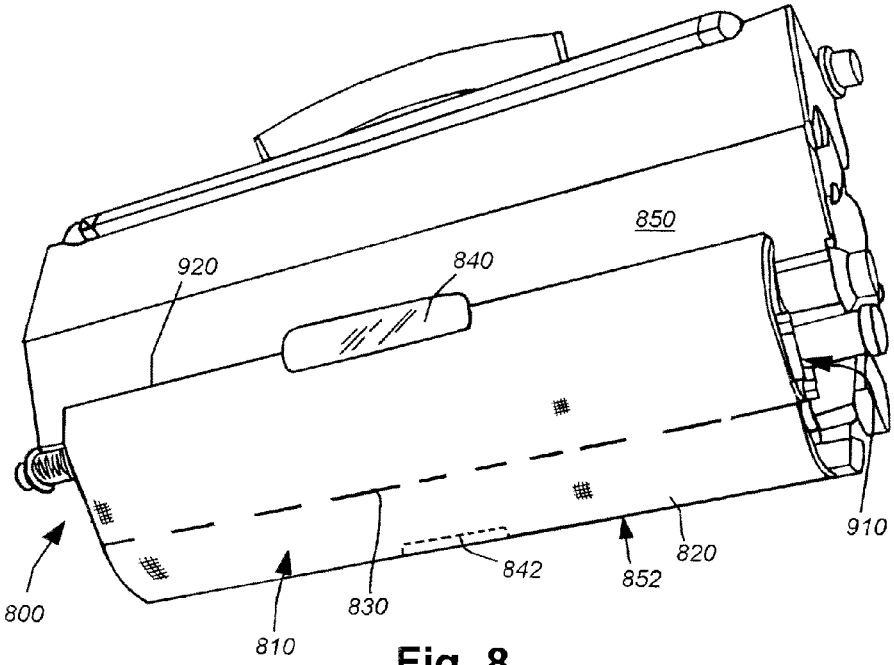
FIG. 8 is a perspective view of an exemplary toner tank section showing the seal assembly according to the embodiment of FIG. 3 mounted and removably adhered to the surface of the toner tank section, in preparation for removal.
Figure 9:
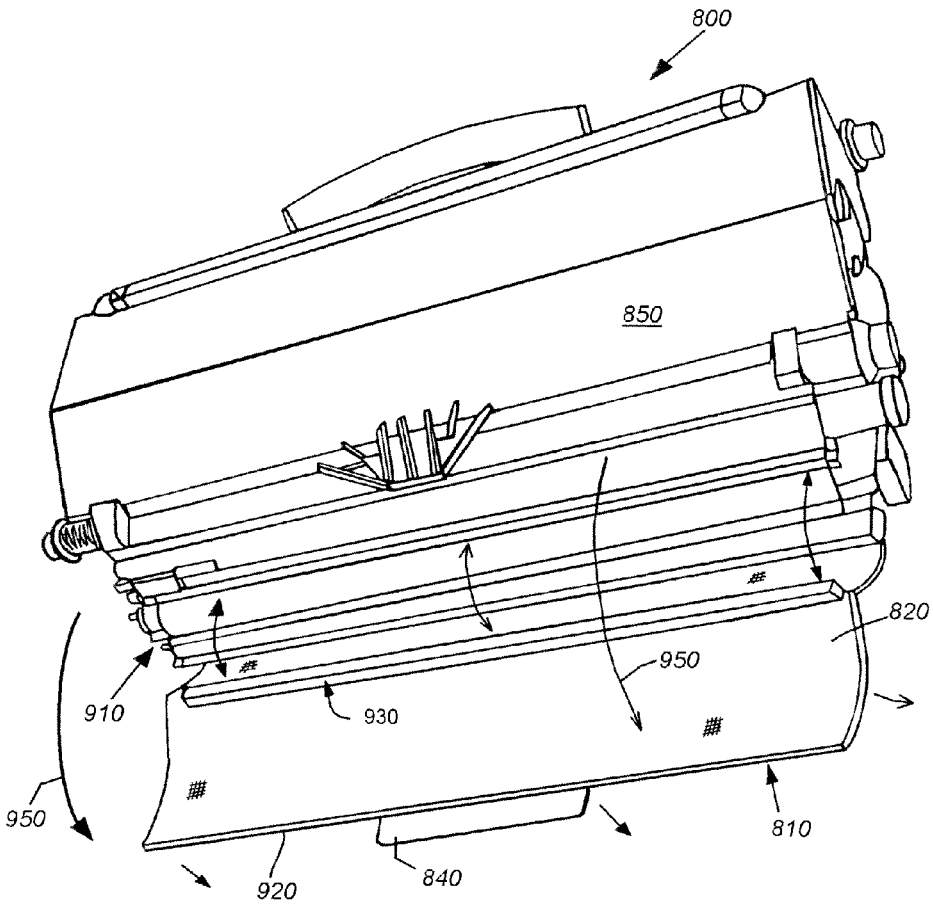
FIG. 9 is a perspective view of the exemplary toner tank section and seal assembly of FIG. 8 showing a first edge of the seal assembly removed from the surface of the tank section.
Figure 10:
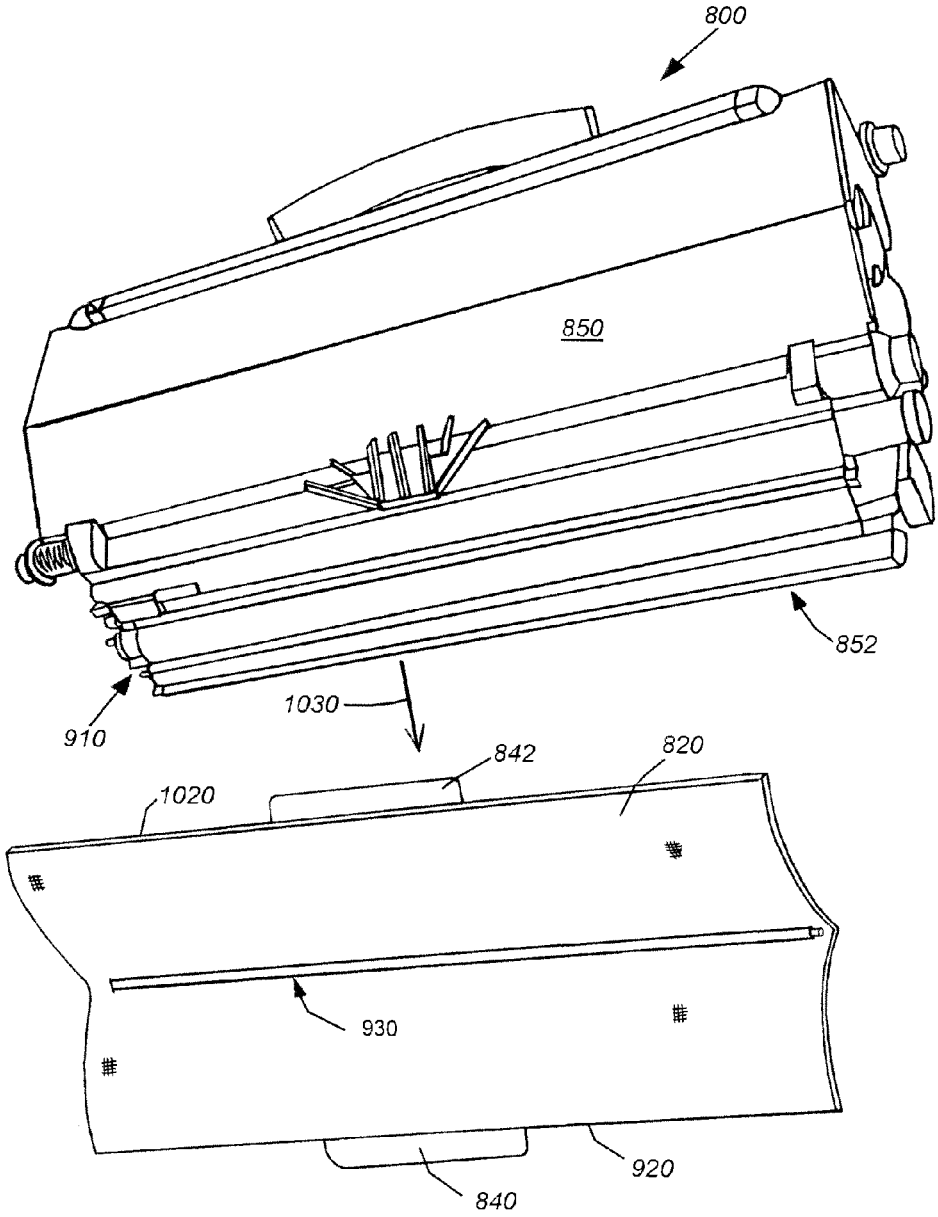
FIG. 10 is a is a perspective view of the exemplary toner tank section and seal assembly of FIG. 8 showing a second edge of the seal assembly removed from the surface of the tank section so that the seal assembly is fully removed and the tank section is ready for assembly into a two-piece cartridge unit.
Figure 11:
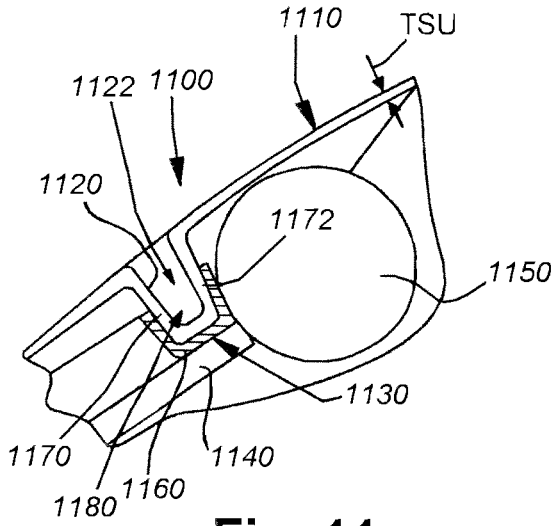
FIG. 11 is a is a fragmentary side cross section of an exemplary toner tank section having the seal assembly mounted at the junction of the developer roller and doctor blade, in which the seal assembly and stiffening bar are formed as a unitary structure, according to another alternate embodiment.

Having described various embodiments of the seal assembly ad their positioning upon the tank section, reference is now made to FIGS. 8-10, which describe the removal of the seal to place the tank section into condition for use with the drum section of a toner cartridge (not shown). The exemplary tank and developer section 800 is shown with the seal assembly 810 covering the developer section. The stiffening bar and pliable cap are positioned generally beneath the sheet 820 in the region of the dashed centerline 830, where they engage the doctor blade and bias it to prevent deformation of the blade from toner pressure and the resulting toner leakage. The sheet 820 is secured by an adhesive strip or tape 840, 842. The length of the adhesive strip, tape or region is highly variable. In various embodiments, pressure-sensitive and releasable adhesive can be applied directly to the edges (920, 1020) of the sheet 820. The edges are secured to each of opposing tank housing surfaces 850, 852 by the respective strips 840, 842. The tension provided by the attachment of the sheet provides the loading force to the stiffening bar and pliable cap.

As shown in FIG. 9, the user releases the strip 840, so as to disengage the sheet edge 920 from the confronting tank housing surface 850. A variety of techniques can be used to remove the seal assembly 810 (e.g. pull away one sheet edge at a time, pull away both sides together, etc.). In this example, the first edge 920 is pulled away (curved arrows 950), allowing the sheet 820 with associated bar and pliable cap 930 to be withdrawn from the developer roller arrangement 910. The stiffening bar and pliable cap assembly 930 is shown exposed.

Next, as shown in FIG. 10, the user releases the opposing adhesive strip 842, and withdraws (arrow 1030) the seal assembly 810 completely away from the tank and developer section 800. The tank and developer section is now ready for assembly with the photosensitive drum of a two-piece toner cartridge unit.

It should be clear that the seal assembly described in accordance with the various embodiments herein is an effective and relatively inexpensive mechanism for sealing a toner tank and developer section of a two-piece toner cartridge unit against leakage. The sealing assembly is easily attached and easily removed, and provides a non-protruding arrangement that does not interfere with conventional cartridge-packaging arrangements.

As described generally above, a seal assembly 1100 according to another alternate embodiment is described in further detail. This seal assembly has dimensions generally similar to those described above. The illustrative seal assembly 1100 is constructed with a unitary sheet 1110 and stiffening bar 1120. The sheet has a thickness TSU that is between approximately 0.05 and 1.25 inch. This thickness is also (approximately) provided to the walls of the stiffening bar. Notably, the stiffening bar 1120 in this embodiment is an indentation (hollow cavity 1122) in the sheet 1110, which is a semi-rigid polymer. In an embodiment, the sheet and stiffening bar are molded or vacuum-formed using a form that provides the generalized cross-sectional shape of the depicted seal assembly 1100. As shown the bar 1120 defines a slight taper toward its top end 1130. The sheet can be formed with a slight concave surface that conforms approximately to the curved shape of the underlying tank section surface. The sheet's concave shape can be defined so that, when the sheet is adhered to the tank surface, there is a slight elastic deflection that exerts a biasing force on the bar top 1130 against the doctor blade 1140. That is, in a resting state, one or both edges of the sheet sit above the tank surface, and securing them down to the surface generates a spring force that biases the bar toward the doctor blade. This helps to maintain its seal against the developer roller 1150 as described above. A foam (or other pliable material) cap 1160 extends along the top and at least a portion of each side 1170, 1172 of the stiffening bar 1120. The stiffening bar can include a symmetrical or asymmetrical cross-sectional shape. An asymmetrical shape can be adapted to better fit within the cross section of the sealing region 1180 in which it resides. The foam cap can be any acceptable thickness that allows for a snug, non-movable fit. It is attached to the stiffening bar using a pressure-sensitive adhesive, glue or any other acceptable attachment technique.

In a vacuum-forming process, the sheet is laid onto a mold cavity (not shown) and subjected to heat and suction. The stiffening bar feature is formed by drawing part of the sheet into a deeper well within the surrounding mold. The bar can thereby define opposing ends (along the cartridge's widthwise direction) that terminate remote from (inset from) the side edges of the sheet. The forming of a unitary sheet and stiffening bar according to the various embodiments described herein can be accomplished in accordance with a variety of manufacturing techniques that should be clear to those of skill in the art. In an alternate embodiment, the shape of the sheet and the stiffening bar can be achieved through extrusion processes.

It should be clear that the toner tank section seal assembly in accordance with the various embodiments contemplated herein provides an inexpensive-to-manufacture and easy-to mount structure that effectively prevents toner leakage in both standard-life and extended life (higher capacity) toner tanks When attached, the seal does not interfere with normal packaging techniques, and quick an easy to remove when a user desired to install the tank in a two-piece cartridge assembly. More generally, the seal help to avoid an undesirable mess from leaking toner that may soil his or her hands, clothing and workspace, and also avoids the diminishment of the user's faith in the quality of the unit.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the bar, cap and sheet can be formed together as a co-extrusion. Likewise, the materials used for forming the seal assembly can have other desirable properties, such as moisture resistance, anti-static, and the like. Also, while the seal assembly described herein is employed for the toner tank and developer section of a two-piece toner cartridge, it is expressly contemplated that the seal described herein can be adapted for use with other cartridge types that can benefit from the properties of the seal assembly in accordance with the various embodiments contemplated herein. Also, while the sheet is contemplated as being flexible or semi-flexible, in alternate embodiments the sheet can define a formed, rigid or semi-rigid shell that conforms to the shape of the confronting portion of the tank and developer section. Moreover, while the various embodiment employ a releasable adhesive to removably secure the sheet to the surface of the tank section, it is expressly contemplated that other mechanisms can be employed such as mechanical fasteners (e.g. clips, locking tabs and the like) that engage an existing or modified structure on the surface adapted to receive these fasteners—such as a slot that receives an illustrative tab on the sheet. Accordingly, this description is meant to be taken only by way of example, and not to otherwise limit the scope of this invention.

What is claimed is:

1. A sealing assembly for a section of a toner cartridge having a developer roller and doctor blade comprising:

a flexible sheet constructed and arranged to extend over the developer roller and doctor blade between a first side and a second side of a housing surface of the section;

a stiffening bar and pliable cap assembly interconnected to the flexible sheet that engages a region defined by the doctor blade, developer roller and an adjacent portion of the section that biases the doctor blade into a predetermined sealing orientation with respect to the developer roller.

2. The sealing assembly as set fort in claim 1 wherein the pliable cap assembly comprises a foam material that surrounds at least a portion of a top and at least a portion of a side of the stiffening bar.

3. The sealing assembly as set forth in claim 2 wherein the flexible sheet is removably secured to the housing surface by an adhesive interconnection adjacent to each of opposing edges of the flexible sheet.

4. The sealing assembly as set forth in claim 3 wherein the adhesive interconnection comprises adhesive strips attached to each of the opposing edges.

5. The sealing assembly as set forth in claim 1 wherein the stiffening bar and the pliable cap assembly are constructed as a unitary member.

6. The sealing assembly as set forth in claim 1 wherein the sheet comprises at least one of a paper-based material and a polymer material.

7. The sealing assembly as set forth in claim 1 wherein the stiffening bar comprises at least one of a polymer material, a metal material, a composite material and a wood-based material.

8. The sealing assembly as set forth in claim 1 wherein the pliable cap assembly comprises a foam material that surrounds at least a portion of a top and at least a portion of each of opposing sides of the stiffening bar.

9. The sealing assembly as set forth in claim 1 wherein the stiffening bar is unitarily formed with the sheet.

10. The sealing assembly as set forth in claim 9 wherein the sheet and the stiffening bar comprise a polymer material.

11. The sealing assembly as set forth in claim 10 wherein the wherein the sheet and the stiffening bar are constructed and arranged to exert a bias force between the stiffening bar and the doctor blade when opposing edges of the sheet are removably secured to the first side and the second side of the housing surface.

12. A method for sealing a section of a toner cartridge having a developer roller and doctor blade comprising the steps of:

locating a flexible sheet to extend over the developer roller and doctor blade between a first side and a second side of a housing surface of the section; and engaging a stiffening bar and pliable cap assembly interconnected to the flexible sheet to a region defined by the doctor blade, developer roller and an adjacent portion of the section so as to bias the doctor blade into a predetermined sealing orientation with respect to the developer roller.

13. The method as set forth in claim 12 further comprising removably securing the flexible sheet to the housing surface by an adhesive interconnection adjacent to each of opposing edges of the flexible sheet.

14. The method as set forth in claim 13 wherein the adhesive interconnection comprises adhesive strips attached to each of the opposing edges.

15. The method as set forth in claim 12 further comprising providing the stiffening bar and the pliable cap assembly as a unitary member.

16. The method as set forth in claim 12 further comprising providing the stiffening bar unitarily formed with the sheet.

17. The method as set forth in claim 12 further comprising exerting, with the sheet and the stiffening bar, a bias force between the stiffening bar and the doctor blade when opposing edges of the sheet are removably secured to the first side and the second side of the housing surface.

* * * * *